United States Patent [19]

Huff

[11] Patent Number: 4,893,363

[45] Date of Patent: Jan. 16, 1990

[54] HANGING WALL TABLE FOR SWIMMING POOLS

[76] Inventor: Harold E. Huff, 7 Edwards La., Belleville, Ill. 62223

[21] Appl. No.: 247,174

[22] Filed: Sep. 21, 1988

[51] Int. Cl.[4] ..... E04H 3/18

[52] U.S. Cl. ..... 4/496; 4/579; 248/235; 108/47

[58] Field of Search ..... 4/494, 496, 546, 559, 4/579, 597, 630, 638, 656; 297/254; 248/206.3, 214, 215, 235; 108/47

[56] References Cited

U.S. PATENT DOCUMENTS

| | | | |
|---|---|---|---|
| 893,930 | 7/1908 | Lederman . | |
| 1,174,755 | 3/1916 | Mullen | 108/47 X |
| 1,223,272 | 4/1917 | Gurley | 108/47 X |
| 1,309,965 | 7/1919 | Schwab | 108/47 X |
| 1,371,715 | 3/1921 | West | 4/579 |
| 1,630,889 | 5/1927 | Clarke . | |
| 1,899,480 | 2/1933 | Ravlin . | |
| 2,123,257 | 7/1938 | Provost | 40/10 |
| 2,142,263 | 1/1939 | Bentz | 155/36.5 |
| 2,302,806 | 11/1942 | Senter | 4/559 X |
| 2,680,523 | 6/1954 | Heeter | 211/86 |
| 2,720,436 | 10/1955 | Covey | 108/47 X |
| 2,881,039 | 4/1959 | Guzman | 108/47 X |
| 3,017,155 | 1/1962 | Scarpetti | 248/235 |
| 3,113,677 | 12/1963 | Johnson | 248/214 X |
| 4,376,521 | 3/1983 | Walters | 248/206 |
| 4,656,678 | 4/1987 | Lipski | 4/559 X |

*Primary Examiner*—Charles E. Phillips
*Attorney, Agent, or Firm*—Robbins & Robbins

[57] ABSTRACT

A hanging wall table for swimming pools is provided consisting of polyvinyl chloride tubing or the like, which forms the frame of the table and engages the above-ground pool wall by a J-shaped hanging support, and a shelf made of plastic or the like. Suction cups are provided on the lower end of the frame to provide stability when the table is employed. This swimming pool wall table may be easily assembled from a kit and is simply erected to provide a firm and stable support for poolside accessories and can be employed for various above ground pool structures.

4 Claims, 1 Drawing Sheet

HANGING WALL TABLE FOR SWIMMING POOLS

BACKGROUND OF THE INVENTION

Above ground pools are a popular recreational feature of many homes and are easily installed in any backyard. It is a relatively inexpensive alternative to sub-level built-in pools. One of the shortcomings of the above ground pool, however, is that there is no deck around the circumference of the pool to place thereon refreshments, suntan oil, towels and the like. The top of the pool wall provides only a narrow ledge for placement of these items. Even if items are placed on the narrow ledge, they may easily be knocked into the pool or on the ground. It would be advantageous to have a storage shelf outside the pool and below the top of the wall so that items are within easy reach yet are not subject to being knocked over accidentally by the pool occupant. There exists a need for a table accessory for the above ground pool which can be easily assembled and installed and which can provide a firm and stable support shelf for various items within the easy reach of the pool user.

There exist in the prior art many tables and shelfs that are adapted to be hung over or attached to a wall. There has not been provided, however, an above ground pool wall table structure using polyvinyl chloride tubing and fittings and a suction cup for the bottom support which can easily be assembled from a kit.

SUMMARY OF THE INVENTION

By means of the instant invention there is provided an above ground swimming pool wall table comprised of plastic tubing and fittings, such as polyvinyl chloride, which form hanging arms and a table support frame, a table shelf of plastic or the like, and suction cups for supportive attachment to the wall. The wall table of this invention may be assembled as a kit and can be very simply erected to provide a firm and stable support for poolside accessories.

The polyvinyl chloride frame of the invention is provided with a pair of inverted J-shaped support arms which rest over the top of the pool wall. The frame provides a support for the table shelf which is positioned outside the pool a few inches below the top of the wall. Beverages, suntan lotion and the like are thus placed within easy reach of the pool user. The suction cups provided on the lower end of the frame stabilize the table as it is suspended from the pool wall.

It is thus an object of this invention to provide an above ground swimming pool wall table and frame of polyvinyl chloride which may suspend from the wall of the pool.

It is another object of this invention to provide a swimming pool wall table that can be placed outside the pool in a firm and stable manner within the easy reach of the pool occupant.

It is another object of this invention to provide a swimming pool wall table which may be easily assembled from a kit.

The above features are objects of this invention. Further objects will appear in the detailed description which follows and will be otherwise apparent to those skilled in the art.

For purpose of illustration of this invention a preferred embodiment is shown and described hereinbelow in the accompanying drawing. It is to be understood that this is for the purpose of example only and that the invention is not limited thereto.

IN THE DRAWINGS

DESCRIPTION OF THE INVENTION

Figure 5:
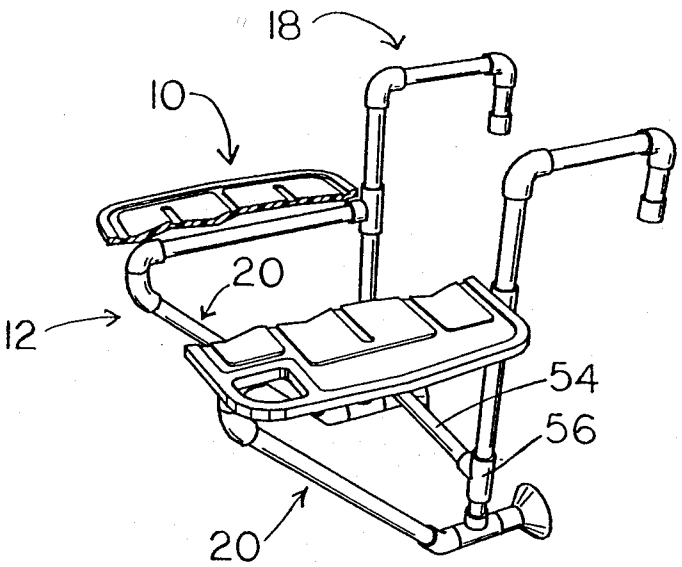
FIG. 5 is a pictorial view of the hanging table with the table shelf partly broken away.

The hanging wall table of this invention is generally designated by the reference numeral 10 in FIGS. 1 through 5. It is comprised of a tubular frame 12, table shelf 14 and suction cups 16.

Figure 1:
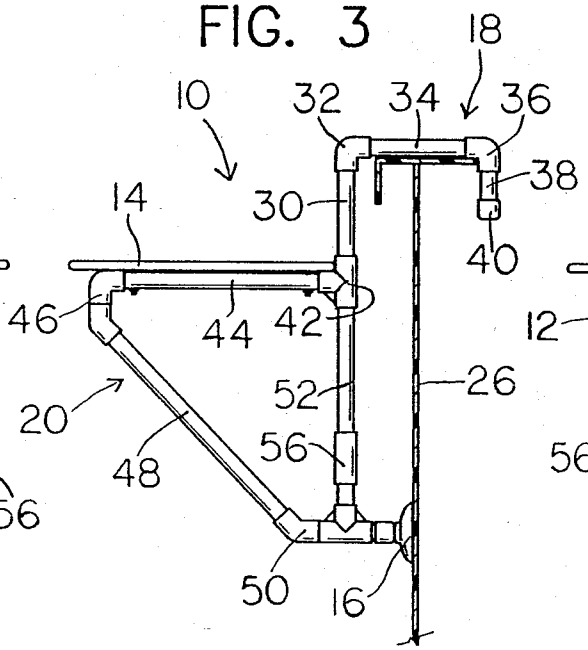
FIG. 1 is a view in side elevation of the hanging table as it is employed on the side wall of an above ground swimming pool.

The tubular frame 12 is constructed of polyvinyl chloride plastic or the like. It is comprised of tube lengths and fittings to form a pair of J-shaped or hook shaped hanging support arms 18 and a pair of triangular support bases 20 as best shown in FIGS. 1 and 5. The bottom of the frame is equipped with suction cups 16 which face rearwardly of the frame. Table shelf 14 is secured on top of triangular support bases 20 as shown in the breakaway illustration of FIG. 5.

Hanging support arms 18 each consist of 3 tube lengths coupled together by two L-shaped fittings to form the J-shaped arms as shown in FIG. 1. Tube length 30 rises vertically from the triangular support and has its upper end joined to an opening of fitting 32. Tube length 34 is joined to the other opening of fitting 32 on one of its ends and extends horizontally to an opening of fitting 36 on its other end and is designed to rest on top wall edge surface. Tube length 38 depends verically from the other opening of fitting 36 and engages the interior of the pool wall 26 to keep the table in place. Protective cap 40 is placed on the end of tube length 38 to prevent injury to the pool user from any sharp edges.

Each triangular support base 20 is attached to a hanging support arm by a T-shaped fitting 42 as shown in FIG. 1. Tube length 44 joins at one end to fitting 42 at its side opening and extends horizontally at its other end to fitting 46. Table shelf 14 is secured, by screws or the like, to the top edge of tube length 44. Tube length 48 angles down inwardly from fitting 46 and is attached to fitting 50. Tube length 52 forms the third leg of the triangular support base and extends vertically at its upper end from T-shaped fitting 42 to fitting 50. Suction cup 16 attaches to the lower corner of triangular base support 20 at fitting 50.

Figure 2:
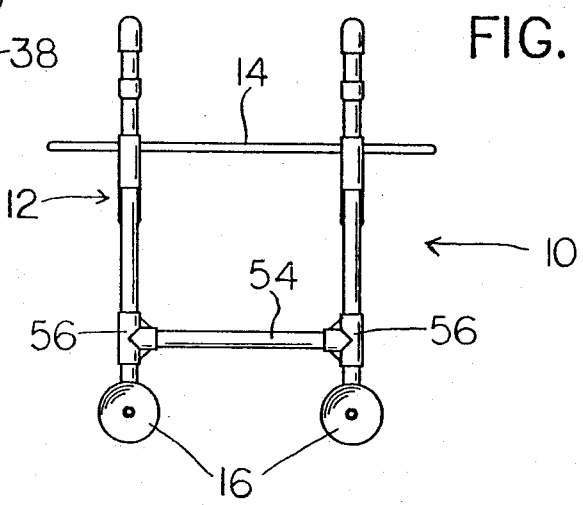
FIG. 2 is a view in rear elevation of the hanging table.
Figure 3:
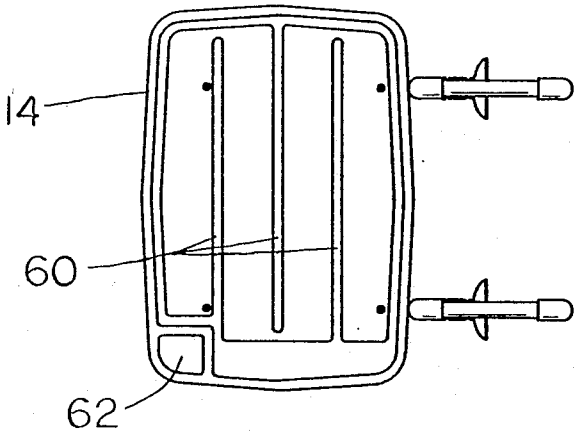
FIG. 3 is a top plan view of the hanging table.
Figure 4:
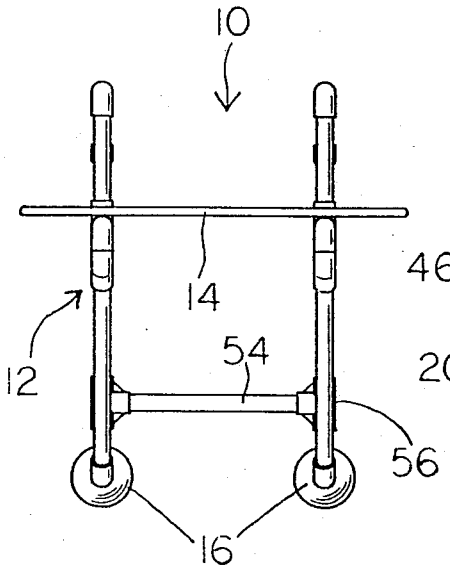
FIG. 4 is a view in front elevation of the hanging table.

Tube lengths 52 and 30 form a common vertical extension for the triangular base and the hanging support arm. Each set of connected hanging support arm 18 and triangular support base 20 are joined together by secured table shelf 14, at the top, and by tube length 54, which attaches to fittings 56, at the bottom, as shown in FIGS. 2 and 4. A rigid table and support frame is thereby provided. The various tube lengths may be connected to the fittings by conventional cement or sealants or by press-fitting as will be readily understood.

Table shelf 14 is constructed of plastic or the like and is equipped with grooves 60 for water drainage and hole 62 at the border for hanging towels or other items.

USE

The hanging swimming pool wall table of this invention is very simply employed on any above ground swimming pool. J-shaped hanging support arms 18 rest over the flat top of the swimming pool wall as shown in FIG. 1. The rest of tubular frame 12 depends from the support arms and is stablized and supported against the pool wall by the suction cups 16 which engage the face of the wall.

The dual triangular support bases 20 provide a stable support for table shelf 14 which is secured thereto. The top arm of each support base is situated sufficiently below the edge of the top of the pool so that the table shelf rests at a position where items placed thereon are not subject to being accidentally tipped over by the pool user.

The grooved top surface of the table serves to provide a dry, elevated top. The towel hole further provides a convenient storage place for a towel which is visible and readily accessible.

The hanging wall table of this invention is lightweight and very easy to assemble, as well as being durable and easy to clean, due to the polyvinyl chloride tubing and fittings and plastic table shelf.

It is to be understood that other materials, such as aluminum tubing or a wooden shelf, may be employed in the table.

Various changes and modifications may be made within this invention as will be apparent to those skilled in the art. Such changes and modifications are within the scope and teaching of this invention as defined in the claims appended hereto.

What is claimed is:

1. A hanging table for support upon a side wall of an above the ground swimming pool which comprises a tubular frame consisting of at least two hanging J-shaped support members adapted to fit over a top of the pool side wall, at least two triangular support bases coplanar with and oriented below said hanging support members, a vertical leg member forming a vertical leg of said triangular base and extending therefrom to form a vertical leg portion of said J-shaped support member in each of said triangular bases and support members, a horizontally extending brace member being fixed to a bottom portion of each of said triangular bases to connect said bases together in rigid relationship, a table shelf which is secured upon top edges of said triangular support bases, and suction cups attached to said triangular bases to engage the side wall from which said frame is supported, and said frame being comprised of polyvinyl chloride tubing and fittings which may be easily assembled from a kit.

2. The hanging table of claim 1 in which said table shelf has a top surface which defines grooves whereby water drains off.

3. The hanging table of claim 1 in which said table shelf has an enlarged opening at a border portion of the table of a size sufficient to receive and support a towel.

4. The hanging table of claim 1 in which said table shelf has a top surface which defines grooves whereby water drains off and said table shelf has an enlarged opening at a border portion of the table of a size sufficient to receive and support a towel.

* * * * *